US006582191B2

(12) United States Patent
Addie et al.

(10) Patent No.: US 6,582,191 B2
(45) Date of Patent: Jun. 24, 2003

(54) LINER FOR CENTRIFUGAL SLURRY PUMPS

(75) Inventors: Graeme R. Addie, Martinez, GA (US); Edward L. Ray, Evans, GA (US)

(73) Assignee: GIW Industries, Inc., Grovetown, GA (US)

( * ) Notice: Subject to any disclaimer, the term of this patent is extended or adjusted under 35 U.S.C. 154(b) by 0 days.

(21) Appl. No.: 10/054,197

(22) Filed: Jan. 22, 2002

(65) Prior Publication Data

US 2003/0035721 A1 Feb. 20, 2003

Related U.S. Application Data

(60) Provisional application No. 60/312,813, filed on Aug. 16, 2001.

(51) Int. Cl.[7] ..... F04D 29/02
(52) U.S. Cl. ..... 415/197; 415/204; 415/206
(58) Field of Search ..... 415/196, 197, 415/204, 205, 206

(56) References Cited

U.S. PATENT DOCUMENTS

| | | | | | |
|---|---|---|---|---|---|
| 2,258,527 | A | * | 10/1941 | Warman | 415/113 |
| 3,146,722 | A | * | 9/1964 | Warman | 415/205 |
| 4,264,273 | A | * | 4/1981 | Grzina | 415/197 |
| 4,722,664 | A | * | 2/1988 | Wissman | 415/197 |

* cited by examiner

*Primary Examiner*—Ninh H. Nguyen
(74) *Attorney, Agent, or Firm*—Womble Carlyle Sandridge & Rice, PLLC

(57) ABSTRACT

An abrasion-resistant liner assembly for the suction branch of a centrifugal pump of the type having a suction connection for mating with a suction source, and a relief annulus formed in the suction connection, including a cylindrical liner, a groove formed in the outer surface of the liner and extending circumferentially around the liner, a seat ring positioned within the groove, and a seat ring holder positioned adjacent the seat ring on the inner end of the liner, wherein when the liner is positioned within the suction branch and the suction flange is mated with a suction source, the seat ring projects into the relief annulus, and the seat ring holder prevents axial movement of the liner.

15 Claims, 4 Drawing Sheets

LINER FOR CENTRIFUGAL SLURRY PUMPS

RELATED APPLICATIONS

This application is a non-provisional application claiming the benefit of Provisional Application Serial No. 60/312,813, filed Aug. 16, 2001, the content of which is hereby incorporated in its entirety.

FIELD OF THE INVENTION

This invention generally relates to centrifugal pumps, and, more particularly to suction and discharge pump liners for centrifugal pumps used to pump a mixture of solids and carrier liquid.

BACKGROUND OF THE INVENTION

Centrifugal pumps, as the name implies, employ centrifugal force to lift liquids from a lower to a higher level or to produce a pressure. This type of pump, in its simplest form, comprises an impeller consisting of a connecting hub with a number of vanes and shrouds, rotating in a volute collector or casing (See FIGS. 1 and 2). Liquid drawn into the center, or eye, of the impeller is picked up by the vanes and accelerated to a high velocity by rotation of the impeller. It is then discharged by centrifugal force into the casing and out the discharge branch of the casing. When liquid is forced away from the center of the impeller, a vacuum is created and more liquid flows into the center of the impeller. Consequently there is a flow through the pump.

There are many forms of centrifugal pumps, including single-stage and multi-stage constructions. They may have impellers (vanes) with or without front shrouds, and may be single or double suction pumps. In any case, however, the abrasive nature of a solid/liquid mixture passing through a centrifugal slurry pump is such that the wetted components have to be made of wear-resistant material or wear-resistant liners have to be installed to reduce wear and prevent premature pump failure. The wear-resistant materials used to form the liners may be hard iron or elastomer, depending on the application and the size of the solids in the slurry. It has been found that the softer an elastomer liner is, the less wear is experienced. Lower softness (durometer), however, also means lower strength and greater flexibility of the material. This then requires some back support attached to the shell of the pump to resist the fluctuating pressure forces, and in some cases a vacuum.

Further problems with centrifugal pumps having liners installed therein are vacuum and cavitation. That is, as slurry is drawn into the eye of the impeller, a vacuum often results, and indeed, is expected, as it is the vacuum that draws the slurry into the pump. As would be expected, a vacuum has a collapsing effect, causing a soft liner to collapse inward. This seriously diminishes the capacity and operating characteristics of the pump. Additionally, where the pressure within the pump casing happens to be lower than the vapor pressure at the pump suction inlet, cavitation is inevitable. With a soft liner installed, flutter of the liner can occur, resulting in rapid degradation of the liner, and often the pump. This, then, requires that additional support be provides to the outer portions of the liners.

In a typical lined slurry pump, the pump casing is radially split and held together by bolts in order to enable the liners to be replaced. While it is easy to provide molded-in metal support plates to the faces of the elastomer liners and for these to be assembled by taking advantage of the split halves and the circularity, it is not so easy to provide support for the extended suction and discharge branch sections of the pump. It is possible, in the case of the discharge branch, to provide a relief in the face of the flange that a top hat section of the elastomer can be seated in. The split halves are easily assembled and sealed by providing an excess of elastomer (rubber) at the split and at the flange face. Special metal stiffeners can then be provided for any unsupported section of the branch. Providing support for the suction branch is not as simple since the suction is not split. Where the suction branch section has no support and the elastomeric liner is sufficiently soft, it is possible to provide the suction branch with a top hat flanged section that can be collapsed and pushed through the metal plate at the suction flange so that it is held in place at the discharge flange. Where, however, elastomers such as strengthened rubbers or urethanes are harder, it is more difficult, or in some cases impossible, to position the elastomer liner within the suction branch since the elastomer cannot be collapsed down for positioning. A further problem is that it has not been possible to provide proper support to the elastomer in a suction branch section because this would prevent collapsing the elastomer to fit it into the branch. The lack of support in such as case can cause fluttering, collapse and/or failure of the elastomer in the suction branch due to pulsing of the impeller vane and/or cavitation.

SUMMARY OF THE INVENTION

The present invention is directed to an abrasion-resistant liner assembly for the suction branch of a centrifugal pump that addresses the problems described above. Specifically, the assembly of the present invention may be easily installed on a single or multi-stage, single or multiple suction pump of the type having (1) at least one suction connection, or flange, for mating engagement with a suction source such as piping, (2) a suction inlet, (3) and, an annular region formed in the suction connection. While the present invention may be installed on a variety of pump types, exemplary installation on a single-stage, single suction centrifugal pump will be explained in detail herein A preferred embodiment of the liner assembly includes a cylindrical liner having an outer, or inlet end, an inner end, and a diameter substantially conforming in dimension to the diameter of the suction branch inlet of the pump. A groove is formed in the outer surface of the liner and extends around the outer diameter of the liner to form a continuous recessed channel. A split-type seat ring with an inner diameter similar to that of the outer diameter of the recessed channel is positioned within the groove. The seat ring is dimensioned with an outer diameter larger than the outer diameter of the cylindrical liner, and hence, the suction branch, and substantially conforming in dimension to the diameter of the annular region formed in the suction flange of the pump. When seated in the groove, the seat ring engages the inner surface of the annular region, preventing the cylinder from moving axially inward toward the impeller of the pump. A seat ring holder of typically more rigid material is positioned adjacent the seat ring on the outer end of the liner. The seat ring holder has an inner diameter substantially conforming in dimension to the outer diameter of the liner and an outer diameter dimensioned to fit within the annular region. When the liner is positioned within the suction branch and the suction flange mated with a suction source (piping), the seat ring thus projects into the annular region and the seat ring holder prevents the liner from moving axially outward toward the connected suction source.

In another embodiment, the liner assembly includes a reinforcing cylinder attached to the outer surface of the elastomeric liner. The reinforcing cylinder may be formed of steel or other suitable rigid material and molded or adhered to the elastomeric liner. The cylinder provides additional support for operating conditions where the suction branch is subjected to vacuum and inlet cavitation.

While the abrasion-resistant liner assembly of the present invention is described with respect to installation in the suction branch of a pump, the same liner assembly may just as easily be installed in the discharge branch of a pump.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
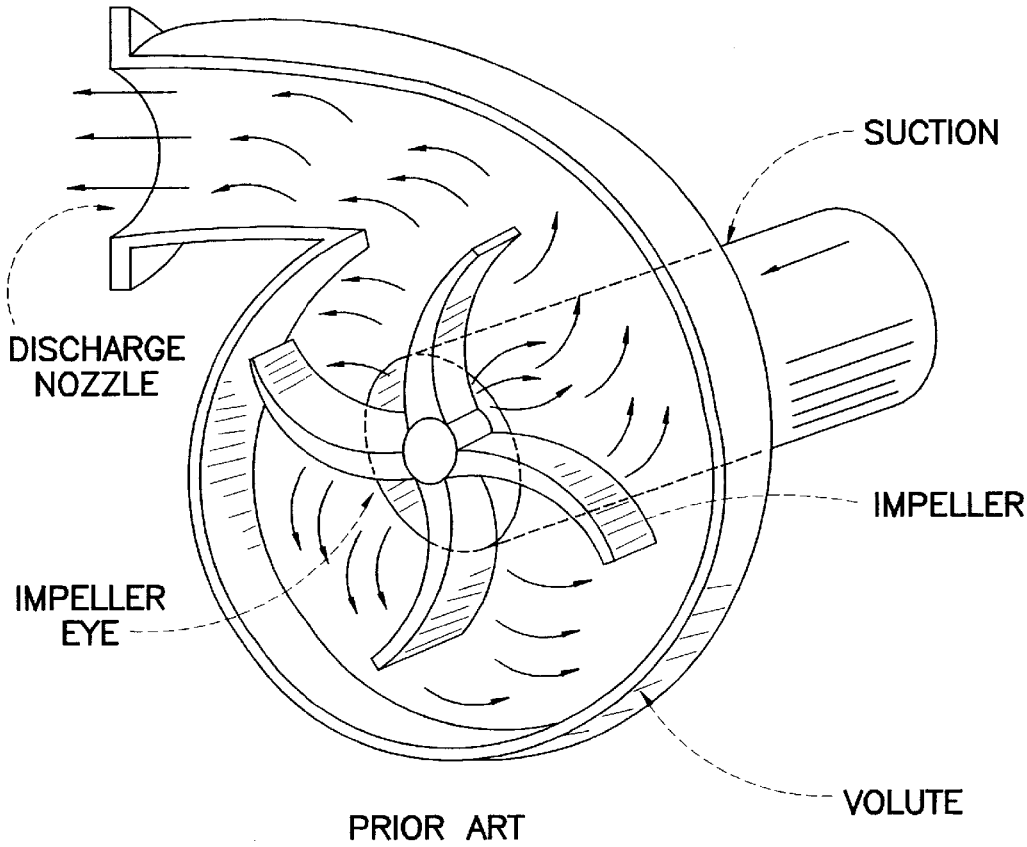
FIG. 1 is a simplified schematic illustrating the fundamental components and operation of a conventional single stage centrifugal pump.
Figure 2:
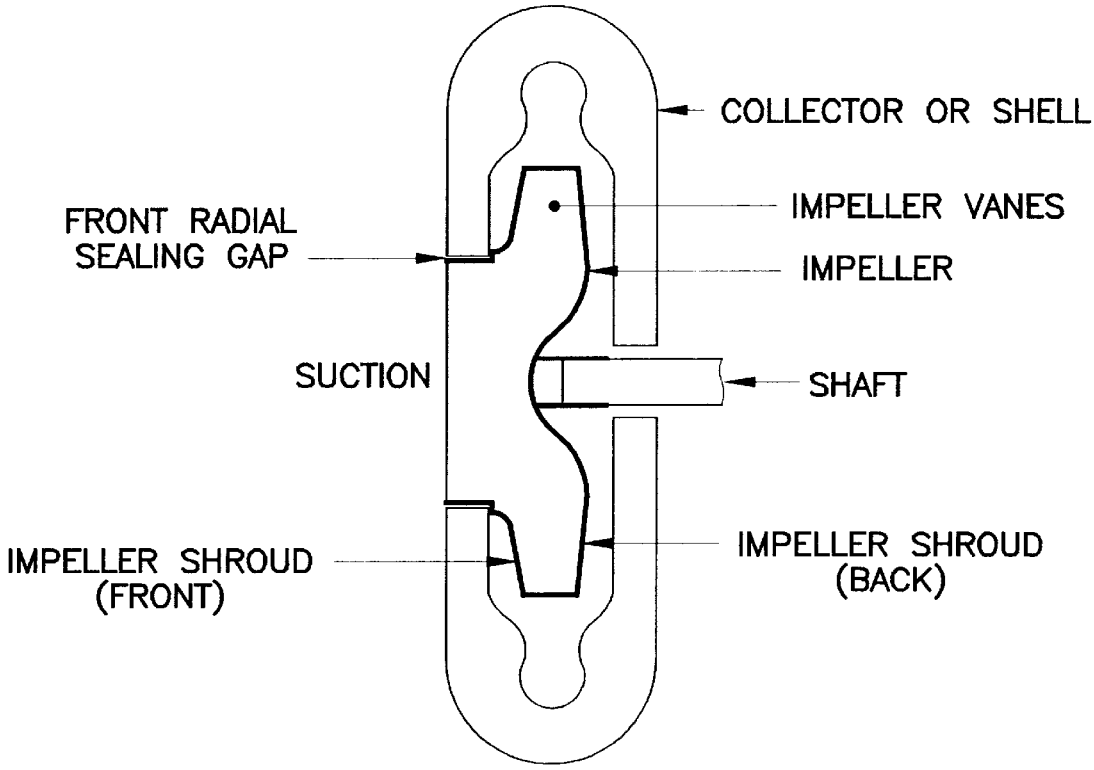
PRIOR ART FIG. 2
FIG. 2 is a cross-sectional view of the interior of a conventional single stage centrifugal pump.
Figure 3:
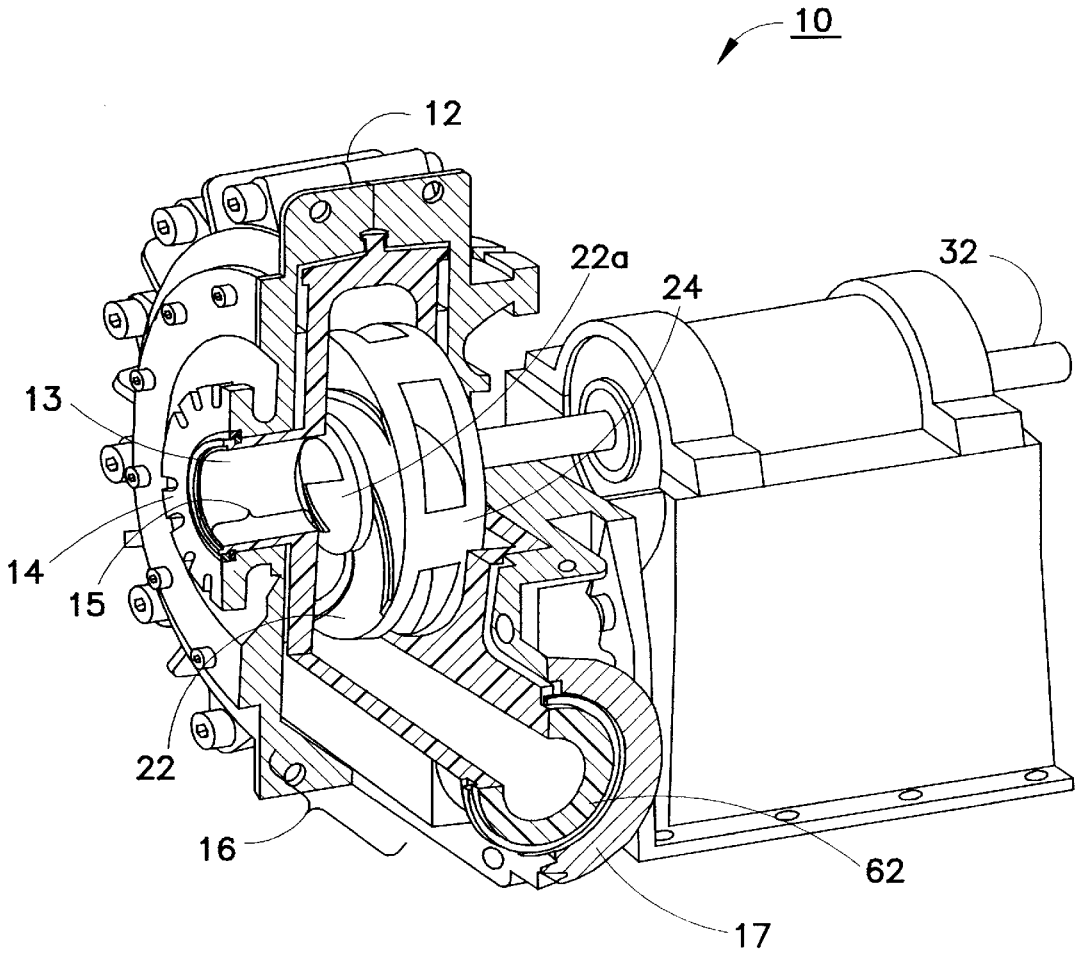
FIG. 3 is a front perspective cut away view of a single stage centrifugal pump with the liner assembly of the present invention installed therein.

Referring now to FIG. 3, shown generally as 10 is a single-stage, single-suction centrifugal pump. The pump 10 shown is a horizontal construction of the type used for pumping a mixture of solid and liquid material, commonly referred to as "slurry".

Pump 10 comprises a casing, or volute, 12 that houses the single impeller 22. Impeller 22 is rotated by a shaft 32 that is coupled to a motive power source (not shown) such as an electric motor. Aligned axially with impeller 22 is the pump suction inlet 13. Suction inlet 13 is the point of entry for slurry being drawn into the volute 13. Suction inlet 13 is typically coupled to a suction source via piping (not shown) that mates with a suction flange 14 surrounding suction inlet 13. Slurry enters the suction inlet and moves inward through the length of the suction branch 15 to the eye 22*a* of the impeller 22. The counterclockwise rotation of the impeller 22 pushes the slurry on the back of the impeller vanes 24, imparting radial motion and pressure to the slurry. The slurry is forced outward through the discharge branch 16. The discharge branch 16 is typically connected to discharge piping (now shown) that is coupled to the discharge flange 17. Depending upon the size of the pump and the rotational velocity of the impeller 22, hundreds or thousands of gallons per minute of slurry are drawn inward through the suction inlet 13 and discharged outward under pressure each minute.

Figure 4:
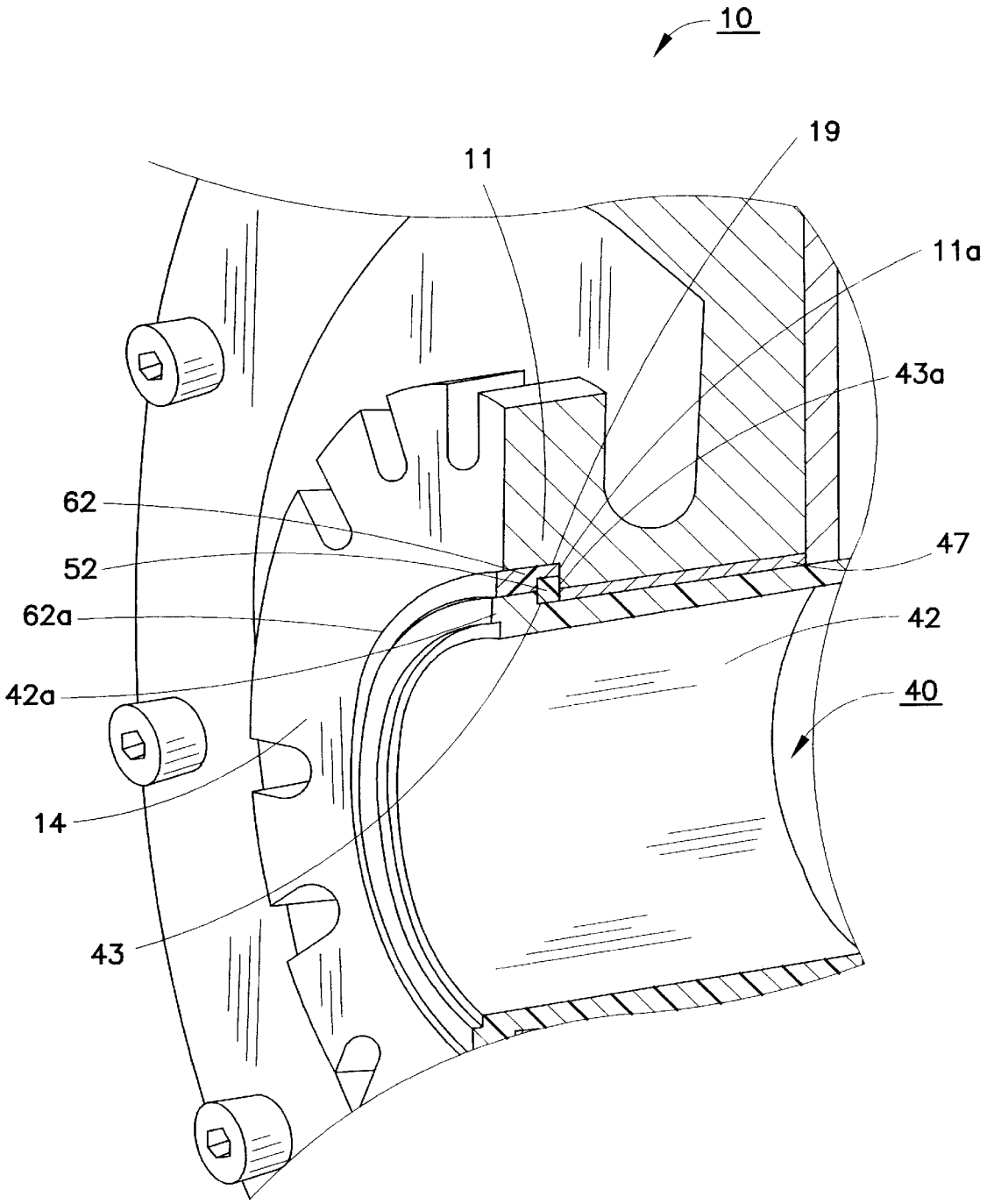
FIG. 4 is a front perspective cut away view of the centrifugal pump and liner assembly of FIG. 3, illustrating the relative position of each component of the liner assembly.

To protect the suction branch surfaces against abrasion, a liner assembly is installed in the suction branch 15 of pump 10. As best seen in FIG. 4, in a first preferred embodiment of the present invention, a liner assembly 40 comprises a cylindrical elastomeric liner 42, a seat ring 52, and a seat ring holder 62. The elastomeric liner 42 is a cylindrical tube having an inner diameter and an outer diameter that define a wall thickness therebetween, the wall thickness chosen for the particular pump and the specific application thereof. The durometer, or hardness, of the elastomeric material forming the cylindrical tube is also selected for the particular service in which the pump is placed and is not considered a critical limitation of the present invention. The elastomeric liner 42 is dimensioned axially to extend approximately from the inner end (not shown) of the suction branch 15 to slightly beyond (about 1 to 2 mm) the end of the suction flange 14. This protrusion outward beyond the end of suction flange 14 ensures that some compression of elastomeric liner 42 will occur when suction flange 14 mates with suction piping (not shown), providing a positive seal between the mating portions.

A flat groove, or recessed channel, 43 is formed in elastomeric liner 42. The groove 43 is formed inward from the outer edge 42*a* of the liner. The precise location of the groove 43 depends upon the depth of the annular region 11 of pump 10 and the distance that the liner 42 projects outward beyond the edge of suction flange 14. As referred to herein, the annular region 11 of pump 10 is a circumferential recess formed in the face of suction flange 14, and having an outer diameter greater than the outer diameter of the suction inlet 13/cylindrical liner.

During installation, cylindrical liner 42 is slid into position in suction branch 15 without the need to flex or collapse liner 42 since the outer diameter of the liner approximates the diameter of the suction branch 15. This permits the liner to be formed from an elastomeric material having a higher durometer than has been used in the prior art. Once in place, and as described above, liner 42 is dimensioned in length so that it will project outward beyond suction flange 14 by about 1 to 2 mm so that it is compressed when the mating surfaces of flange 14 and the suction source are joined; however, liner 42 need not project beyond flange 14 for the liner assembly of the present invention to provide satisfactory results. Rather, other sealing arrangements commonly known in the art may be used for sealing together the mating portions of the suction flange and the suction source.

A split seat ring 52 is next positioned within recessed groove 43, extending circumferentially around liner 42. Split seat ring 44 is desirably formed of a flexible urethane. A split ring construction is desirable since it allows the ring to be opened, or flexed, in order to extend over the outer diameter of liner 42. In this fashion, the split seat ring 44 will then, return to an unopened condition, nesting seat ring 44 within groove 43. The unopened seat ring 44 has an inner diameter substantially corresponding to the outer diameter of groove 43, and an outer diameter somewhat larger than the outer diameter of liner 42. Thus, when installed, ring 44 projects circumferentially outward from liner 42. The outer diameter of ring 44 is chosen such that it will fit within the annular region 11 formed in the face of suction flange 14. Once in place, seat ring 44 interlocks with liner 42. Annular region wall 11*a* prevents inward axial movement of cylindrical liner 42.

To ensure that liner 42 does not move axially outward when installed, a urethane seat ring holder 62 is employed. As shown in FIG. 4, the seat ring holder 45 is circular and dimensioned with an inside diameter corresponding to the outside diameter of liner 42, and an outer diameter substantially conforming to the diameter of the annular region 11 in the suction inlet flange 14. While not limited hereto, it has been found that when the seat ring holder is formed in an L-shape, as shown in FIG. 4, it more positively engages and holds the surfaces of seat ring 52. The outer edge 62*a* of seat ring holder 62 protrudes slightly outward beyond the face of the suction flange 14, as does the cylindrical liner 42, to provide a positive seal when the mating portions of the suction flange 14 and the suction piping are attached. This protrusion is typically about 1/16 inches.

In a second embodiment of the present invention, liner assembly 40 further includes a reinforcing cylinder 47 that surrounds and attaches to the outer surface of the cylindrical liner 42. The reinforcing cylinder 47 is preferably formed of a thin and rigid material such as steel; however, as those skilled in the art will appreciate, there are many suitable substitutes. Reinforcing cylinder 47 may be molded into the outer surface of the elastomeric liner 42 when liner 42 is initially formed, or may be adhered with any of the materially-compatible adhesives known in the art. Reinforcing cylinder 47 provides additional rigidity to liner 42, enabling the liner to withstand operating conditions such as vacuum and cavitation. Reinforcing cylinder 47 need not extend along the entire length of liner 42 or cover the entire outer surface of liner 42. Desirably, however, it extends from the inner edge (not shown) of liner 42 to inner edge 43*a* of groove 43.

Referring again to FIG. 3, those skilled in the art will appreciate that the liner assembly of the present invention, as described in detail above for the suction branch of a centrifugal pump, may also be easily installed in the discharge branch of a centrifugal pump of the type having a discharge connection for mating with a discharge outlet and a relief annulus formed in the discharge connection. Shown generally as 62, the discharge branch liner assembly is constructed and installed in the same manner as the suction branch liner assembly.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An abrasion-resistant liner assembly for the suction or discharge branch of a centrifugal pump of the type having a suction connection for mating with a suction source and a relief annulus formed in the suction connection, a discharge connection for mating with a discharge outlet and a relief annulus formed in the discharge connection, comprising a cylindrical liner having an outer surface and outer and inner ends, a groove formed circumferentially around the outer surface of the cylindrical liner, a seat ring positioned within the groove to prevent axial movement of the liner inward, and a seat ring holder positioned adjacent the seat ring on the outer end of the liner, wherein when the liner is positioned within a selected one of the suction and discharge branch, and the selected one of the suction and discharge connection is mated with a selected one of the suction source and discharge outlet, the seat ring projects into the relief annulus of the selected one of the suction and discharge connection, and the seat ring holder prevents axial movement of the liner outward.

2. An abrasion-resistant liner assembly for the suction branch of a centrifugal pump of the type having a suction flange for mating with a suction source, a suction inlet with a first diameter, and a relief annulus formed in the suction flange and having a second diameter larger than the first diameter of the suction inlet, comprising:

(a) a cylindrical liner having an outer end, an inner end, an outer surface, and an outer diameter substantially conforming in dimension to the first diameter of the suction inlet;

(b) a groove formed in the outer surface of the liner and extending circumferentially around the liner;

(c) a seat ring positioned within said groove, said seat ring having an outer diameter substantially conforming in dimension to the second diameter of the relief annulus;

(d) a seat ring holder positioned adjacent the seat ring on the inner end of the liner and having an inner diameter substantially conforming in dimension to the outer diameter of said liner and an outer diameter dimensioned to fit within the second diameter of the relief annulus; and (e) wherein when the liner is positioned within the suction branch and the suction flange mated with a suction source, the seat ring projects into the relief annulus, and the seat ring holder prevents axial movement of the liner.

3. The assembly of claim 2 wherein the cylindrical liner is elastomeric.

4. The assembly of claim 2 further including a reinforcing cylinder attached to the outer surface of the cylindrical liner.

5. The assembly of claim 4 where the reinforcing cylinder is steel.

6. The assembly of claim 4 wherein the reinforcing cylinder extends from about the inner end of the liner to the groove in the liner.

7. The assembly of claim 2 wherein the seat ring is urethane.

8. The assembly of claim 2 wherein the seat ring is a split seat ring.

9. A centrifugal pump of the type used for pumping an abrasive slurry, comprising:

(a) a pump having a casing, at least one impeller housed within the casing, a suction flange for mating with a suction source, a suction inlet with a first diameter, and a relief annulus formed in the suction flange and having a second diameter larger than the first diameter of the suction inlet;

(b) a cylindrical liner having an outer end, an inner end, an outer surface, and an outer diameter substantially conforming in dimension to the first diameter of the suction inlet;

(c) a groove formed in the outer surface of the liner and extending circumferentially around the liner;

(d) a seat ring positioned within said groove, said seat ring having an outer diameter substantially conforming in dimension to the second diameter of the relief annulus;

(e) a seat ring holder positioned adjacent the seat ring on the inner end of the liner and having an inner diameter substantially conforming in dimension to the outer diameter of said liner and an outer diameter dimensioned to fit within the second diameter of the relief annulus; and (e) wherein when the liner is positioned within the suction branch and the suction flange is mated with a suction source, the seat ring projects into the relief annulus, and the seat ring holder prevents axial movement of the liner.

10. The assembly of claim 9 wherein the cylindrical liner is elastomeric.

11. The assembly of claim 9 further including a reinforcing cylinder attached to the outer surface of the cylindrical liner.

12. The assembly of claim 11 where the reinforcing cylinder is steel.

13. The assembly of claim 11 wherein the reinforcing cylinder extends from about the inner end of the liner to the groove in the liner.

14. The assembly of claim 9 wherein the seat ring is urethane.

15. The assembly of claim 9 wherein the seat ring is a split seat ring.

* * * * *